US005971372A

United States Patent [19]

Ash

[11] Patent Number: 5,971,372

[45] Date of Patent: Oct. 26, 1999

[54] AERATOR TRANSPORT SYSTEM

[76] Inventor: Gary Ash, 1751 S. Skyridge Dr. South, Mt. Vernon, Wash. 98274

[21] Appl. No.: 08/985,327

[22] Filed: Dec. 4, 1997

[51] Int. Cl.[6] ..... B01F 3/04

[52] U.S. Cl. ..... 261/120; 210/242.2

[58] Field of Search ..... 261/120, 91; 210/242.2

[56] References Cited

U.S. PATENT DOCUMENTS

| | | | |
|---|---|---|---|
| 257,028 | 4/1882 | Leede | 73/198 |
| 3,320,160 | 5/1967 | Welles, Jr. et al. | 261/120 X |
| 3,589,997 | 6/1971 | Grutsch et al. | 261/120 X |
| 3,595,538 | 7/1971 | Baumann | 261/120 X |
| 3,675,779 | 7/1972 | Grutsch et al. | 210/242.2 |
| 3,756,578 | 9/1973 | McGurk | 261/120 X |
| 3,846,517 | 11/1974 | Ross | 261/120 X |
| 4,482,510 | 11/1984 | Khudenko | 210/242.2 X |
| 4,611,542 | 9/1986 | Pivarunas | 104/173.2 |
| 4,680,148 | 7/1987 | Arbisi et al. | 261/120 |
| 4,832,563 | 5/1989 | Massmann | 414/744.5 |
| 5,176,364 | 1/1993 | Bell | 254/291 |
| 5,374,035 | 12/1994 | Santos | 254/339 |

*Primary Examiner*—Richard L. Chiesa

[57] ABSTRACT

A new aerator transport system for transporting aerators in the fluid held in a lagoon to maximize the uniformity of oxygen distribution and mixing within the lagoon while minimizing the number of aerators required to attain that uniformity. The inventive device includes at least one aerator, a guide cable defining a linear movement path for at least one aerator, a travel cable system for moving each aerator along a movement path, a cable loop drive for moving the travel cable system, and an aerator bracket assembly for operatively linking the aerators to the guide cables and to the travel cable system.

9 Claims, 3 Drawing Sheets

AERATOR TRANSPORT SYSTEM

BACKGROUND OF THE INVENTION

1. Field of the Invention

The present invention relates to systems for aerating fluid and more particularly pertains to a new aerator transport system for transporting aerators in the fluid held in a lagoon to maximize the uniformity of oxygen distribution and mixing within the lagoon while minimizing the number of aerators required to attain that uniformity.

2. Description of the Prior Art

The use of systems for aerating fluid is known in the prior art. More specifically, systems for aerating fluid heretofore devised and utilized are known to consist basically of familiar, expected and obvious structural configurations, notwithstanding the myriad of designs encompassed by the crowded prior art which have been developed for the fulfillment of countless objectives and requirements.

Known prior art systems for aerating fluid include U.S. Pat. No. 4,680,148; U.S. Pat. No. 5,176,364; U.S. Pat. No. 5,374,035; U.S. Pat. No. 4,611,542; U.S. Pat. No. 257,028; and U.S. Pat. No. 4,832,563.

While these devices fulfill their respective, particular objectives and requirements, the aforementioned patents do not disclose a new aerator transport system. The inventive device includes at least one aerator, a guide cable defining a linear movement path for at least one aerator, a travel cable system for moving each aerator along a movement path, a cable loop drive for moving the travel cable system, and an aerator bracket assembly for operatively linking the aerator to the guide cables and to the travel cable system.

In these respects, the aerator transport system according to the present invention substantially departs from the conventional concepts and designs of the prior art, and in so doing provides an apparatus primarily developed for the purpose of transporting aerators in the fluid held in a lagoon to maximize the uniformity of oxygen distribution and mixing within the lagoon while minimizing the number of aerators required to attain that uniformity.

SUMMARY OF THE INVENTION

In view of the foregoing disadvantages inherent in the known types of systems for aerating fluid now present in the prior art, the present invention provides a new aerator transport system construction wherein the same can be utilized for transporting aerators in the fluid held in a lagoon to maximize the uniformity of oxygen distribution and mixing within the lagoon while minimizing the number of aerators required to attain that uniformity.

The general purpose of the present invention, which will be described subsequently in greater detail, is to provide a new aerator transport system apparatus and method which has many of the advantages of the systems for aerating fluid mentioned heretofore and many novel features that result in a new aerator transport system which is not anticipated, rendered obvious, suggested, or even implied by any of the prior art systems for aerating fluid, either alone or in any combination thereof.

To attain this, the present invention generally comprises at least one aerator, a guide cable defining a linear movement path for at least one aerator, a travel cable system for moving each aerator along a movement path, a cable loop drive for moving the travel cable system, and an aerator bracket assembly for operatively linking the aerator to the guide cable and to the travel cable system.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new aerator transport system apparatus and method which has many of the advantages of the systems for aerating fluid mentioned heretofore and many novel features that result in a new aerator transport system which is not anticipated, rendered obvious, suggested, or even implied by any of the prior art systems for aerating fluid, either alone or in any combination thereof.

It is another object of the present invention to provide a new aerator transport system which may be easily and efficiently manufactured and marketed.

It is a further object of the present invention to provide a new aerator transport system which is of a durable and reliable construction.

An even further object of the present invention is to provide a new aerator transport system which is susceptible of a low cost of manufacture with regard to both materials and labor, and which accordingly is then susceptible of low prices of sale to the consuming public, thereby making such aerator transport system economically available to the buying public.

Still yet another object of the present invention is to provide a new aerator transport system which provides in the apparatuses and methods of the prior art some of the advantages thereof, while simultaneously overcoming some of the disadvantages normally associated therewith.

Still another object of the present invention is to provide a new aerator transport system for transporting aerators in the fluid held in a lagoon to maximize the uniformity of oxygen distribution and mixing within the lagoon while minimizing the number of aerators required to attain that uniformity.

Yet another object of the present invention is to provide a new aerator transport system which includes at least one aerator, a guide cable defining a linear movement path for at least one aerator, a travel cable system for moving each aerator along a movement path, a cable loop drive for moving the travel cable system, and an aerator bracket assembly for operatively linking the aerator to the guide cable and to the travel cable system.

Still yet another object of the present invention is to provide a new aerator transport system for moving aerators in a lagoon in a manner responsive to existing fluid conditions in the lagoon (such as the oxygen content in the fluid) and the physical dimensions of the lagoon.

Even still another object of the present invention is to provide a new aerator transport system that will allow movement of aerators in a lagoon without damage to the aerators.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
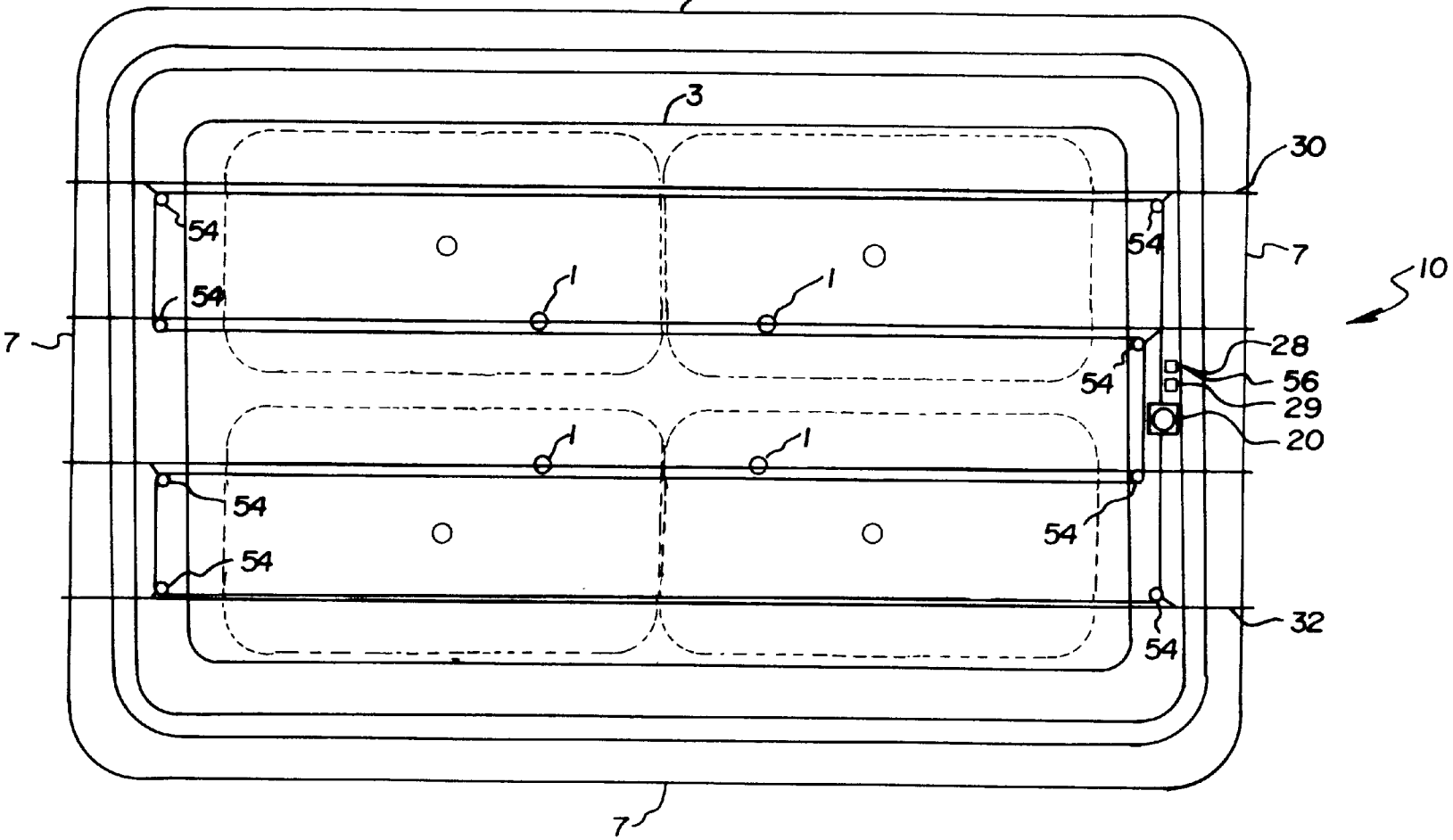
FIG. 1 is a schematic plan view of a new aerator transport system according to the present invention employed on a lagoon.
Figure 2:
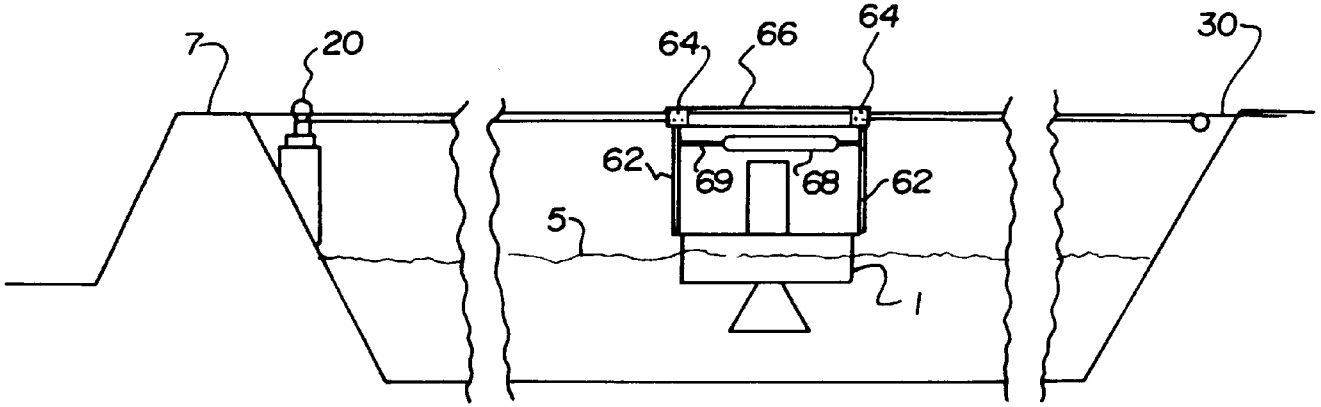
FIG. 2 is a schematic side view of the present invention particularly illustrating the relationship of the invention to a lagoon.
Figure 3:
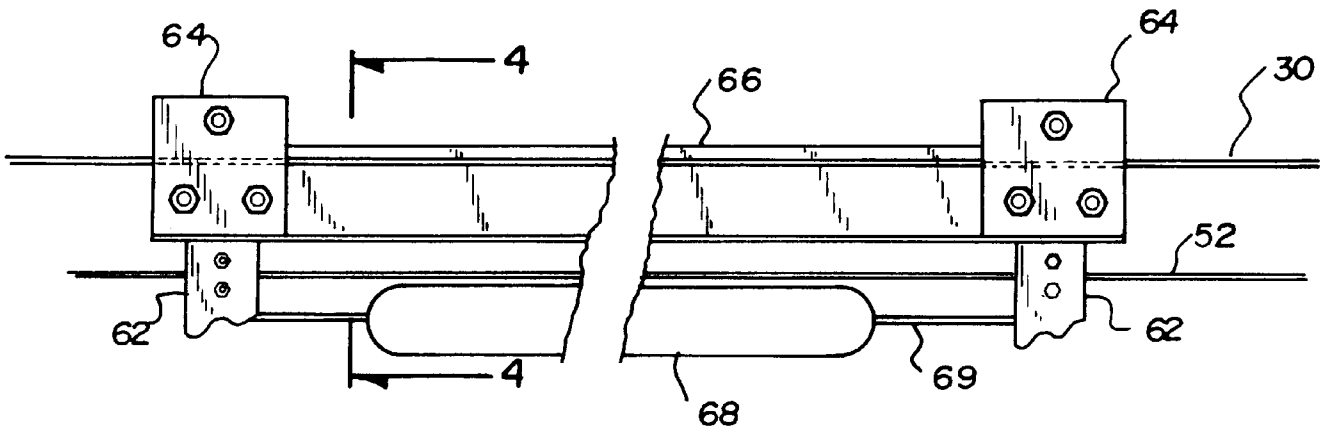
FIG. 3 is a schematic fragmentary side view of a portion of the bracket assembly.

With reference now to the drawings, and in particular to FIGS. 1 through 5 thereof, a new aerator transport system embodying the principles and concepts of the present invention and generally designated by the reference numeral 10 will be described.

As best illustrated in FIGS. 1 through 5, the aerator transport system 10 of the invention is a new apparatus for transporting aerators in the fluid held in a lagoon. The aerator transport system 10 is generally comprised of at least one aerator 11, a guide cable 30 defining a linear movement path for at least one aerator, a travel cable system 50 for moving each aerator along a movement path, a cable loop drive 20 for moving the travel cable system 50, and an aerator bracket assembly 60 for operatively linking the aerators 11 to the guide cable 30, 32 and travel cable system 50.

The transport system 10 is most suitably employed on a body of fluid, such as a lagoon (either natural or manmade), delimited or bounded by opposing sets of berms 7. Generally, an aerator 11 comprises a propeller and a motor means for rotating the propeller on a shaft. Surface aerators useful with the system 10 may have a propeller that is completely or only partially submerged in the fluid in the lagoon 3. Optionally, other types of aerators or agitators or mixers may also be used with the system 10.

The system 10 moves the aerators 11 within the lagoon while the aerators 11 are operational (i.e., rotating) to expand the area of influence of each aerator in the lagoon. The transport system 10 maximizes the uniformity of oxygen distribution and mixing within the lagoon 3 while minimizing the number of aerators 11 required to attain that uniformity.

Preferably the transport system 10 comprises at least two guide cable 30, 32. Each guide cable 30, 32 provides and defines an aerator movement path for the aerators of the system 10. The guide cables 30, 32 are anchored adjacent to the opposing berms 7 in a manner such that each guide cable 30, 32 is suspended over the surface level 5 of the fluid in the lagoon 3 in a substantially parallel relationship to any adjacent guide cables. Each guide cable 30, 32 defines a linear aerator movement path for at least one aerator 11, although more than one aerator may be positioned to move along each guide cable and the linear movement path thereof.

The guide cables 30, 32 are most preferably constructed of a high tensile strength material, with a suitable degree of corrosion resistance for the chemical characteristics of the atmosphere and the fluid within the system environment. Ideally, a cable formed of stainless steel or galvanized steel is employed.

The size of the lagoon 3 (e.g. the distance between opposing berms) may also make it beneficial to employ an optional intermediate floatation support device positioned in the fluid at a medial location along a guide cable to support the cable and thereby minimize sag of the guide cable 30, 32 over a long span between berms. Generally, cable spans greater than about 500 feet will experience some degree of sag and would benefit from the use of a flotation support device.

Optionally, the guide cables 30 could be omitted from the system 10 with the function of guiding the aerators 1 being performed substantially entirely by the travel cable system 50. Such a configuration would likely require strengthening of the travel cable system 50, and may lead to a greater chance of travel cable 52 failure. Also a single guide cable may be used to provide a system to provide a single movement path in the lagoon, and may be especially useful with relatively long and narrow lagoon shapes.

The travel cable system 50 of the invention moves the aerator 11 along the guide cables 30, 32 and the linear movement paths defined thereby. The travel cable system 50 comprises a continuous travel cable loop 52 formed by a cable having opposite ends linked together to form a continuous loop.

The travel cable system 50 also includes an alignment means for aligning portions of the continuous travel cable loop 52 with each guide cable 30, 32 in a manner such that a portion of the cable loop 52 is aligned with and movable along the aerator movement path defined by a guide cable 30, 32. The alignment means preferably comprises a corner pulley 54 located at each end of a guide cable 30, 32 for forming a substantially 90 degree turn in the continuous travel cable loop 52 such that the continuous travel cable loop 52 extends toward the next adjacent guide cable 30, 32.

The alignment means preferably comprises one such corner pulley 54 positioned at the end of each guide cable 30, 32 of the system 10.

The cable loop drive 20 moves the continuous travel cable loop 52 and thereby provides the power to move the aerators 11 in the lagoon 3. The cable loop drive 20 preferably comprises a motor 22 driving a gearbox 24. Preferably, the gearbox 24 comprises a chain and sprocket drive pulley. Optionally, the gearbox 24 may include a v-guide, A-section, belt pulley. The continuous travel cable loop 52 is driven by the gearbox 24 of the cable loop drive 20.

The cable loop drive 20 preferably additionally comprises an operational timer 28 for operating the cable loop drive 20 for a time period and then suspending operation of the drive for a time period. The timer 28 has set points for "time on" and "time off". The "time on" is defined as the time during which the system 10 is powered and operative, and "time off" is defined as the time during which the system 10 is without power and inoperative. Preferably, the operational timer 28 is electrically connected between a power supply and the motor 22. Ideally, the operational timer 28 is located within the power system disconnect box for the aerator transport system 10. However, the operational timer 28 can be housed in a separate, substantially air tight and waterproof enclosure, such as an enclosure meeting the National Electric Manufactures Association 4 standard.

Optionally, a detecting means for detecting the dissolved oxygen concentration level in the fluid is employed to initiate and stop the operation of the aerator transport system 10 (e.g., the cable loop drive 20). This embodiment preferably employs a dissolved oxygen concentration measuring device for detecting a low oxygen concentration in the fluid, and sending a signal to the aerator transport system 10 to initiate operation of the system 10 when a low oxygen concentration is detected. Additionally, upon detecting a high oxygen concentration, a signal would be sent to the aerator transport system 10 to discontinue operation. As a further option, the low oxygen concentration signal may be used to initiate operation of the transport system 10, with operation continuing for a time period controlled by an operation timer which would permit operation for a predetermined time period before the timer turns the system 10 off. Therefore, the low oxygen signal would trigger system operation again when aerator operation is needed.

The cable loop drive 20 has a base or foundation 26 designed to withstand the forces imposed on the drive 20 as the continuous travel cable loop 52 is moved. Additionally, the base 26 provides stability for withstanding any environmental forces exerted by freeze/thaw cycles, wind, or changing fluid levels 5. Preferably, the base 26 is constructed of cast-in-place concrete or of precast concrete. The life expectancy of a properly installed concrete base is believed to be comparable to the life expectancy of the remainder of the equipment in the aerator transport system 10.

Preferably, the travel cable system 50 includes a strain gauge for detecting strain in the cable loop 52 and disabling the system when the detected strain level exceeds a predetermined strain level to prevent damage to the system 10. Most preferably, a shear pin is interposed between and links the ends of the cable forming the travel cable loop 52. If excessive tension is present in the continuous travel cable loop 52, the shear pin is the weak link in the loop 52 that breaks and thereby protects the continuous travel cable loop 52, the gearbox 24, and the surface aerator 11. Optionally, a surface level gauge may be employed to detect a low fluid surface level condition in the lagoon and discontinue system 10 operation when the surface level drops below a predetermined level to protect against the strain induced on the system 10 by that condition. Also optionally, the gearbox 24 may be selected to simply slip when torque at a level that could damage the continuous travel cable loop 52 or the aerators 11.

The cable loop drive 20 includes a reversing means 56 for reversing the travel direction of the continuous travel cable loop 52 to permit the aerators 11 to oscillate (e.g., move back and forth) along the linear movement path of a guide cable 30, 32 without, for example, running into a berm 7 at the side of the lagoon. For example, the travel cable loop 52 moves in one direction for the time required for an aerator 11 on the loop 52 to travel a desired distance, and then the cable loop 52 reverses direction to move the aerator 11 in an opposite direction for the time required to travel back to the start position. The reversing means 56 preferably comprises an electromechanical switching means generally including a lever arm reversing switch for reversing the rotational direction of the motor 22, a box for housing the switch, and an actuator.

Most preferably, the reversing means 56 includes a movement timer 29 to actuate the reversing switch on the cable loop drive 52. The movement timer 29 is programmed to reverse the cable loop drive 52 after a time period based upon the time required for an aerator 11 to move the desired travel distance along the movement path. This time period is a function of the known speed of the gearbox 24. The cable loop drive 20 is reversed by the movement timer 29 acting upon the switch after the expiration of the time period, upon which the movement timer 29 resets itself for another (preferably substantially equal) time period as the aerator 11 moves in the reversed direction. Optionally, the reversing means 56 may comprise a calibrated gear revolution counter (in place of the actuator) for counting the revolutions of the drive pulley of the gearbox 24 to actuate the switch and reverse the cable loop drive 52 after a predetermined number of gear revolutions has been detected.

The cable loop drive 20 should have suitable power for the number of aerators 11 of the aerator transport system 10 being moved. A concrete illustration of the system 10 uses a one horsepower motor 22 to drive a 60:1 ratio gearbox 24, which is suitable power for moving an aerator transport system 10 comprised of four surface aerators 11 operating in a 5.5 million gallon lagoon 3.

Corrosion resistance is a highly desirable characteristic for the cable forming the continuous travel cable loop 52. The travel cable system 50 is continuously exposed to the fluid of the lagoon 3, and system 10 reliability will be dependent upon the continued performance of the continuous travel cable loop 52. However, the degree of corrosion resistance required is dependent upon the chemical characteristics of the fluid. Fluid with a "neutral" pH of 7 will not cause the same level of degradation as will fluid with an elevated or a lowered pH. Preferably, the continuous travel cable loop 52 will be constructed from a continuous loop of stainless steel cable. However, a continuous loop of galvanized steel may also be used for the construction of the continuous travel cable loop 52.

The transport system 10 also preferably includes an aerator bracket assembly 60 that is mounted to the floatation pontoon of the aerator 11, slidably mounted to the guide cables 30, 32, and fixedly mounted to the travel cable 52. The preferred bracket assembly 60 includes an adjustable frame constructed with at least two generally parallel and substantially vertically oriented bracket arms 62. The bracket arms 62 are detachably mounted to a substantially horizontally oriented spreader bar 66 which is generally parallel and adjacent to the guide cable 30, 32. Preferably, the aerator bracket assembly 60 width is marginally wider than the corresponding outside dimension of the pontoon of each aerator 11.

The most preferred bracket assembly 60 includes a bracket float 68. The bracket float 68 supports the bracket assembly during maintenance and repair operations. Ideally, the float 68 is a marine grade inflatable device of the type commonly known as a dock fender. The dock fender is cylindrical, with a cylindrical aperture through its center for mounting. The dock fender is installed upon a floatation support rod 69, for attachment to the aerator bracket assembly 60 in a parallel orientation to the spreader bar 66.

Figure 4:
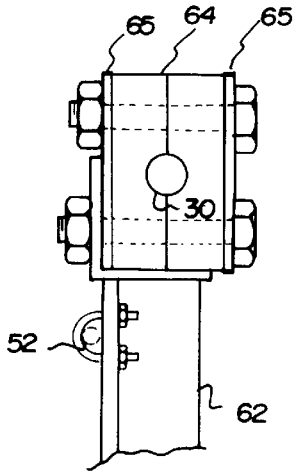
FIG. 4 is a schematic fragmentary end view of the bracket assembly.
Figure 5:
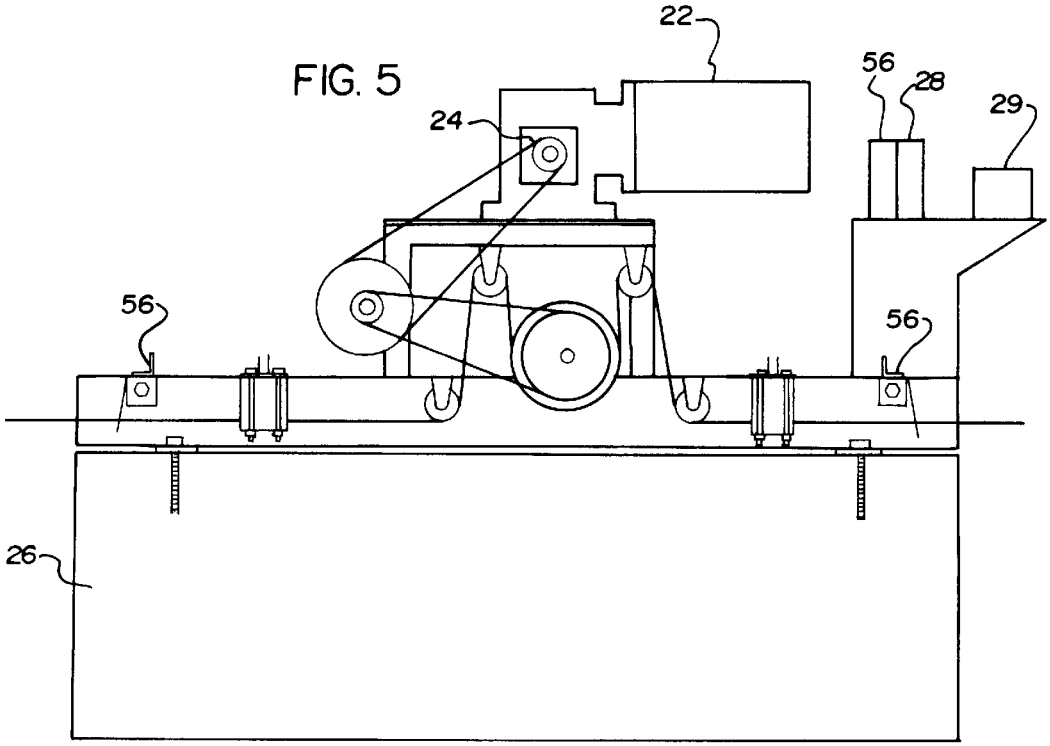
FIG. 5 is a schematic side view of the cable loop drive of the invention.

Attachment means for attaching the guide cable 30, 32 to the aerator bracket assembly 60 preferably comprises a glide block 64 through which the guide cable freely slidably moves (see FIG. 4). A glide block 64 is detachably fastened to each bracket arm 62. Preferably, the glide block comprises two pieces fastened together, with the guide cable 30, 32 sandwiched therebetween. Each part of the glide block 64 is a slotted bearing structure constructed with a machined slot or groove sized to slidably fit the diameter of the guide cable 30, 32. Most preferably, backing plates 65 are detachably mounted on opposite sides of the glide block to sandwich the glide block therebetween for reinforcing the glide block 64.

The travel cable 50 is fixedly mounted to the bracket arm 62 in a manner preventing relative movement therebetween, most preferably with a "C" clamp bolted to the bracket arm 62 below the mounting of the glide block 64.

The bracket assembly 60 for the aerator 11 is most preferably constructed from stainless steel angle stock, however other fabrications may be used. The most preferred material of construction for the glide block 64 is an ultra high molecular weight plastic for facilitating low friction sliding of the glide block along a guide cable 30, 32.

In use, the aerator transport system 10 may be fully automated. The operation timer 28 is programmed with a desired "time on" period and a desired "time off" period. As was stated above, the "time on" is defined as the period of time that power is provided to the aerator transport system 10 and the "time off" is defined as the period of time during which power is withdrawn from the transport system 10. The various setup conditions of the system 10, such as the "time on" and "time off" periods, are determined through particular existing operational considerations, such as the dissolved oxygen concentration and effluent parameters of the fluid in the lagoon 3. For example, the concrete example (cited previously) having four surface aerators 11 for aerating a 5.5 million gallon lagoon 3 for treating food processing wastewater, uses an operational timer 28 with a "time on" equal to about three minutes, and a "time off" equal to about 7 minutes.

Whether the reversing means 56 is a mechanical switch or a second (movement) timer, the distance to be traveled by each aerator before reversing the travel direction is the primary factor used to set up the reversal of the cable loop drive. The preferred reversing means 56 uses a movement timer 29. In order to calibrate the movement timer 29 for the proper time period before reversal, the travel distance is divided by the travel speed of the continuous travel cable loop 52 of the aerator transport system 10. Illustratively, the most desirable travel distance for each aerator may be determined by observing the pattern of "bubbles" or mixing within the lagoon 3 and judging the amount of travel necessary to most effectively cover the lagoon 3 with the bubbles or the mixing pattern. For example, if the travel distance required is 50 feet and the aerator transport system travels at 5 feet per minute, the time before reversal is equal to 10 minutes. This value is based on the time that the aerator transport system is actually operating. Therefore, for the concrete example described above, it would require all of three operating periods (of three minutes each), plus the first minute of the third operating period before a reversal of system movement takes place. A reversal of the system in this example would occur about 46 times each day.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An aerator transport system for aerating a lagoon defined by opposing berms and having a fluid therein with a surface level, said system comprising:

at least one aerator with a floatation pontoon mounted on each aerator, at least two guide cables with each said guide cable having opposite ends anchored adjacent to opposing berms of said lagoon in a manner such that said guide cable is suspended over said lagoon in a substantially parallel relationship to adjacent guide cables, each said guide cable defining a linear aerator movement path along which at least one said aerator is movable;

a travel cable system comprising a continuous travel cable loop and alignment means for aligning a portion of the continuous travel cable loop with each said guide cable, each said aligned portion of said travel cable loop being movable along the aerator movement path defined by a said guide cable;

a cable loop drive acting on said continuous travel cable loop for moving said travel cable loop along said guide cables, said cable loop drive having a reversing means for selectively reversing the direction said cable loop drive moves said continuous travel cable loop along said movement path; and an aerator bracket assembly mounted on each said aerator, said aerator bracket assembly having a movable mounting on said guide cable to permit relative movement therebetween, said aerator bracket assembly being fixedly mounted on said travel cable loop such that movement of said continuous travel cable loop moves said aerator bracket assembly along said guide cable;

wherein said continuous travel cable loop extends between corresponding ends of adjacent said guide cables such that the aligned portions of the continuous travel cable loop for adjacent guide cables move in opposite directions to thereby move aerators on the movement paths of said adjacent guide cables in opposite directions to enhance the mixing and oxygen dispersion capabilities of the aerators.

2. The aerator transport system of claim 1 additionally comprising an operation timer adapted to selectively operate said cable loop drive during a predetermined operative time period and discontinue operation of said cable loop drive during a predetermined inoperative time period.

3. The aerator transport system of claim 1 additionally comprising detecting means for detecting the dissolved oxygen concentration level in the fluid in said lagoon, said detecting means being adapted to activate the reversing means of said cable loop drive when said dissolved oxygen concentration level exceeds a predetermined concentration level.

4. The aerator transport system of claim 1 additionally comprising a movement timer for activating the reversing means of said cable loop drive for a predetermined time period.

5. The aerator transport system of claim 1, wherein each aerator bracket assembly is adapted to allow extension of the distance between the movable mounting on said guide cable and the mounting on said aerator for permitting said guide cable to maintain a substantially linear condition during fluctuations of the surface level of the fluid in the lagoon.

6. The aerator transport system of claim 1 additionally comprising disabling means for stopping operation of the cable loop drive when said disabling means detects that the strain level in said continuous travel cable loop exceeds a predetermined strain level.

7.The aerator transport system of claim 1 wherein the travel cable system includes a shear pin which disables the cable loop drive when the resistance of the fluid to movement by a said aerator therethrough exceeds a predetermined resistance level.

8. The aerator transport system of claim 1 wherein the cable loop drive includes a surface level switch adapted to disable the cable loop drive when the surface level of the fluid in the lagoon drops below a predetermined low fluid level.

9. An aerator transport system for aerating a lagoon defined by opposing berms and having a fluid level comprising:

At least one surface aerator mounted on a floatation pontoon;

at least two guide cables having opposite ends, each said end anchored adjacent to said opposing berms in a manner such that said guide cable is suspended over said lagoon in a substantially parallel relationship to adjacent guide cables defining a linear aerator movement path along which at least one said aerator is movable;

a travel cable system comprising a continuous travel cable loop, alignment means for aligning a portion of the continuous travel cable loop with each said guide cable, each said aligned portion of said travel cable loop being movable along the aerator movement path defined by a said guide cable;

a cable loop drive acting on said continuous travel cable loop for moving said travel cable loop along said guide cables, said cable loop drive having a reversing means for selectively reversing the direction said cable loop drive moves said continuous travel cable loop along said movement path;

an aerator bracket assembly mounted on each said aerator, said aerator bracket assembly having a movable mounting on said guide cable to permit relative movement therebetween and said aerator bracket assembly being fixedly mounted on said travel cable loop such that movement of said continuous travel cable loop moves said aerator bracket assembly along said guide cable;

wherein said continuous travel cable loop extends between corresponding ends of adjacent said guide cables such that the aligned portions of the continuous travel cable loop for adjacent guide cables move in opposite directions to thereby move aerators on the movement paths of said adjacent guide cables in opposite directions to enhance the effect of the aerators;

said travel cable system includes a shear pin which disables the cable loop drive when the resistance of the fluid to movement by a said aerator therethrough exceeds a predetermined resistance level;

said aerator bracket assembly having an inflatable float mechanism removably mounted on a flotation support rod, said flotation support rod being threadably attached to said aerator bracket assembly;

said aerator bracket assembly being extendable between its mounting on said guide cable and its mounting on said surface aerator for maintaining said guide cable substantially linear condition during extreme fluctuations of the lagoon fluid level;

said cable loop drive includes a movement timer for activating the reversing means of said continuous cable loop drive for a predetermined time period;

said cable loop drive incorporates a surface level switch adapted to disable the cable loop drive when the surface level of the fluid in the lagoon drops below a predetermined low fluid level.

* * * * *